US008839702B2

(12) United States Patent
Bagley

(10) Patent No.: US 8,839,702 B2
(45) Date of Patent: Sep. 23, 2014

(54) MANDOLINE SLICER

(75) Inventor: Justin Bagley, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 193 days.

(21) Appl. No.: 13/367,952

(22) Filed: Feb. 7, 2012

(65) Prior Publication Data

US 2012/0198980 A1 Aug. 9, 2012

Related U.S. Application Data

(60) Provisional application No. 61/440,691, filed on Feb. 8, 2011.

(51) Int. Cl.

| | |
|---|---|
| ***B26D 1/04*** | (2006.01) |
| ***B26D 3/28*** | (2006.01) |
| ***B26D 7/26*** | (2006.01) |

(52) U.S. Cl.

CPC ..... *B26D 3/283* (2013.01); *B26D 7/2628* (2013.01); *Y10S 83/932* (2013.01)

USPC ..... 83/435.11; 83/425.3; 83/858; 83/932

(58) Field of Classification Search

USPC ..... 83/425, 425.3, 278, 279, 280, 932, 856, 83/440.2, 435.11

See application file for complete search history.

(56) References Cited

U.S. PATENT DOCUMENTS

| | | | | |
|---|---|---|---|---|
| 4,038,892 | A * | 8/1977 | Popeil | 83/874 |
| 5,765,472 | A * | 6/1998 | Kim | 99/537 |
| 6,036,367 | A * | 3/2000 | Takeda | 384/45 |
| 7,107,890 | B2 * | 9/2006 | Vincent | 83/247 |
| 7,621,207 | B2 | 11/2009 | Botsai et al. | |
| 7,694,615 | B2 * | 4/2010 | DiPietro | 83/425.3 |
| 7,712,402 | B2 * | 5/2010 | Ishii | 83/13 |
| 8,430,010 | B2 * | 4/2013 | Holmes et al. | 83/856 |
| 2004/0200366 | A1 * | 10/2004 | Koerselman et al. | 99/537 |
| 2006/0075872 | A1 * | 4/2006 | Wangler | 83/856 |
| 2007/0089577 | A1 * | 4/2007 | Wong | 83/13 |
| 2008/0028693 | A1 * | 2/2008 | McCauley | 52/126.1 |
| 2009/0255391 | A1 * | 10/2009 | Hood et al. | 83/648 |

FOREIGN PATENT DOCUMENTS

| | | |
|---|---|---|
| DE | 8500705 | 11/1987 |
| EP | 1798010 A2 | 6/2007 |
| GB | 2313771 A | 12/1997 |

OTHER PUBLICATIONS

European Patent Office; Partial European Search Report for European Application No. 12154390.4; Completed on May 18, 2012 and mailed on May 30, 2012; EPO Form 1507U; 8 Pages.

"Easy Slice 2, Folding Mandoline," Zyliss Swiss International, pp. 8, printed May 18, 2009.

* cited by examiner

*Primary Examiner* — Kenneth E. Peterson
*Assistant Examiner* — Jennifer Swinney
(74) *Attorney, Agent, or Firm* — Lowe Graham Jones PLLC

(57) ABSTRACT

A mandoline slicer includes a slicing blade and an adjustable slicing ramp. A series of julienne blades are selectively movable between a stowed and a deployed position above the ramp. At a distal end of the ramp, a portion of the ramp is pivotable between a first position for using the slicing blade and a second position covering the slicing blade and exposing a grating surface.

10 Claims, 9 Drawing Sheets

MANDOLINE SLICER

PRIORITY CLAIM

This application claims the benefit of provisional application Ser. No. 61/440,691 filed Feb. 8, 2011, the contents of which are incorporated by reference.

FIELD OF THE INVENTION

This invention generally relates to mandoline-type slicing devices.

BACKGROUND OF THE INVENTION

Mandoline slicers have been in use for many years, but existing slicers are lacking in one respect or another. Many have slicing guards that are difficult to use or which do not readily follow the path of the slicing tray, leading users to omit them altogether. Consumer slicers are also difficult to adjust and cannot readily be used for a variety of slicing and grating tasks. The typical mandoline slicer is a unitask device that is infrequently used because of its limitations.

SUMMARY OF THE INVENTION

The mandoline slicer as described more fully below includes a slicing blade fixed to a blade tray, with a hand guard positioned for sliding movement over the tray.

In preferred versions of the invention, the slicing blade is adjustable, preferably in a stepped fashion using an adjustment knob indicating particular slicing depths.

Some versions may further include a series of julienne blades that may be retracted below the blade tray when not in use, and selectively extended above the blade tray when in use. As food items are passed over the slicing blade and julienne blades, the food items are cut into thin strips.

A preferred hand guard is secured to one side of the slicer, mounted in a channel formed along one sidewall. The hand guard may be pivoted into an open position to receive the food item to be sliced, and pivoted into a closed position. A series of magnets or other means may be used to retain the slicing guard against the tray.

Yet other versions of the invention include additional features, as described below with respect to the preferred embodiments.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
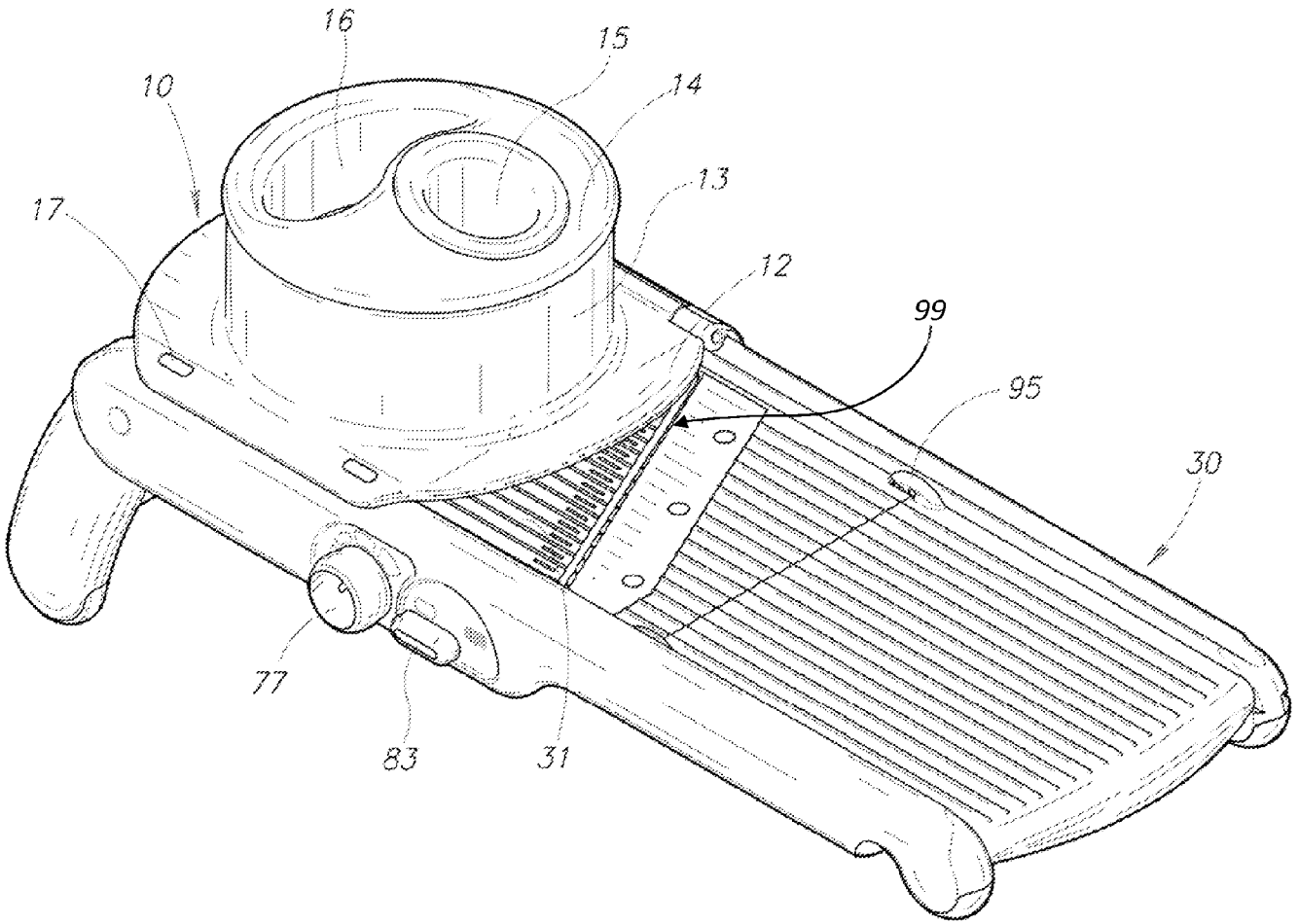
FIG. 1 is a top perspective view of a preferred version of the mandoline slicer, shown with a slicing guard attached.
Figure 2:
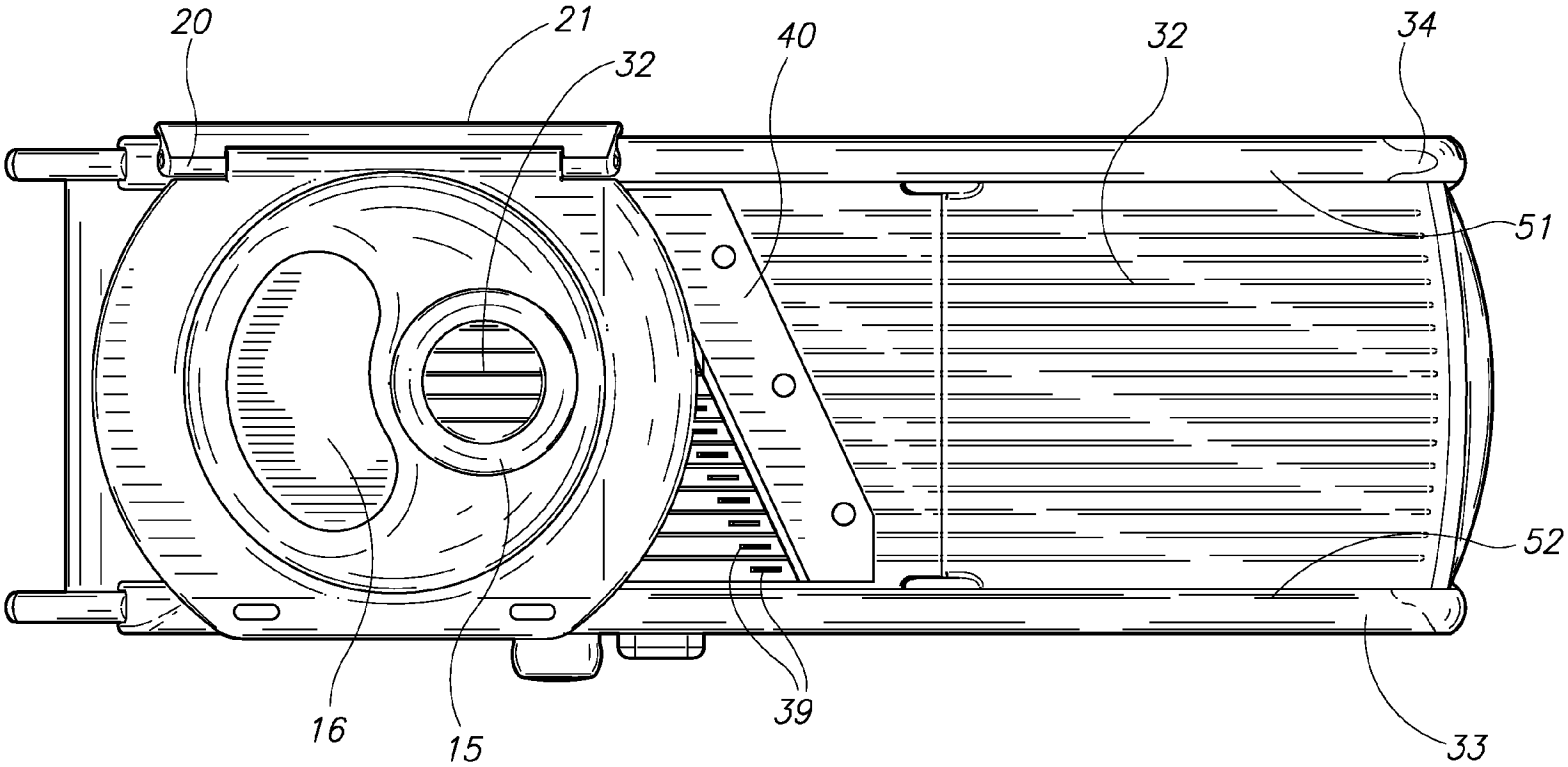
FIG. 2 is a top plan view of the preferred mandoline slicer.

The preferred mandoline slicer as illustrated in FIGS. 1 and 2 includes a hand guard 10 that is configured to slide along a ramp 30 toward a slicing blade 40. In accordance with various preferred aspects of the invention, the ramp may be formed in two sections, including a proximal first section 31 lying beneath the hand guard 10 in FIGS. 1 and 2 and leading toward the slicing blade, and a distal second section 32 extending away from the slicing blade. A gap 99 is defined between the two ramp portions to allow the two portions to be adjusted upward or downward with respect to one another. The first section is adjustable to varying heights below the level of the slicing blade in order to vary the thickness of the slices produced.

The hand guard is formed with a wide flange 12 surrounding a generally cylindrical grip pillar 13. The pillar 13 is hollow at its center and receives a mating cylindrical insert 14. The insert 14 has a bottom end with a series of spikes 18 (see FIGS. 3A and 7) or a similar gripping surface configured to hold a food item in order to slide it along the ramp and toward the blade. The insert is moveable upward and downward within the pillar in order to continue to move downward toward the ramp as a food item is sliced multiple times.

The insert 14, in the example of the invention as shown, includes a bore 15 extending through the insert so that a long food item such as a carrot can be positioned through the bore and into the blade while an opposite end of the food item may extend through the insert, as best seen in the top view of FIG. 2. The vertical sidewalls of the bore may optionally include a series of ridges to reduce friction between the food item and the sidewalls. The insert further may include a finger cup 16, which in the preferred version is sized to receive up to four fingers of the user's hand. Unlike the bore 15, the finger cup 16 is formed with a floor that prevents fingers within the finger cup from contacting the tray or the blades. Thus, items inserted into the bore can pass all the way to the tray and the blades, but items inserted into the finger cup cannot.

The guard is configured to be supported by a pair of sidewalls 33, 34 formed on opposite sides of the ramp. Most preferably, the sidewalls are raised above the generally planar surface of the ramp to provide a degree of clearance of the guard above the ramp. As described further below, the sidewalls serve as guides to ensure a linear path of travel of the guard along the ramp.

One side of the guard flange 12 includes one or more pads 17. The pads are formed from a material intended to improve the ability of the guard to slide along the sidewalls, reducing friction and enhancing durability. In the version as shown, two pads are provided, one toward the front and one toward the back end of a first side of the guard flange, each of the pads having a surface area that is much smaller than the surface area of the flange. Thus, the first side of the guard flange is configured to slide along the first sidewall 33 of the ramp.

The second side of the guard flange includes a pivotal coupling 21 secured to the guard by a hinge 20, as shown in FIG. 2. The coupling ensures that the guard remains in contact with the slicer and cannot become derailed during use.

Figure 9:
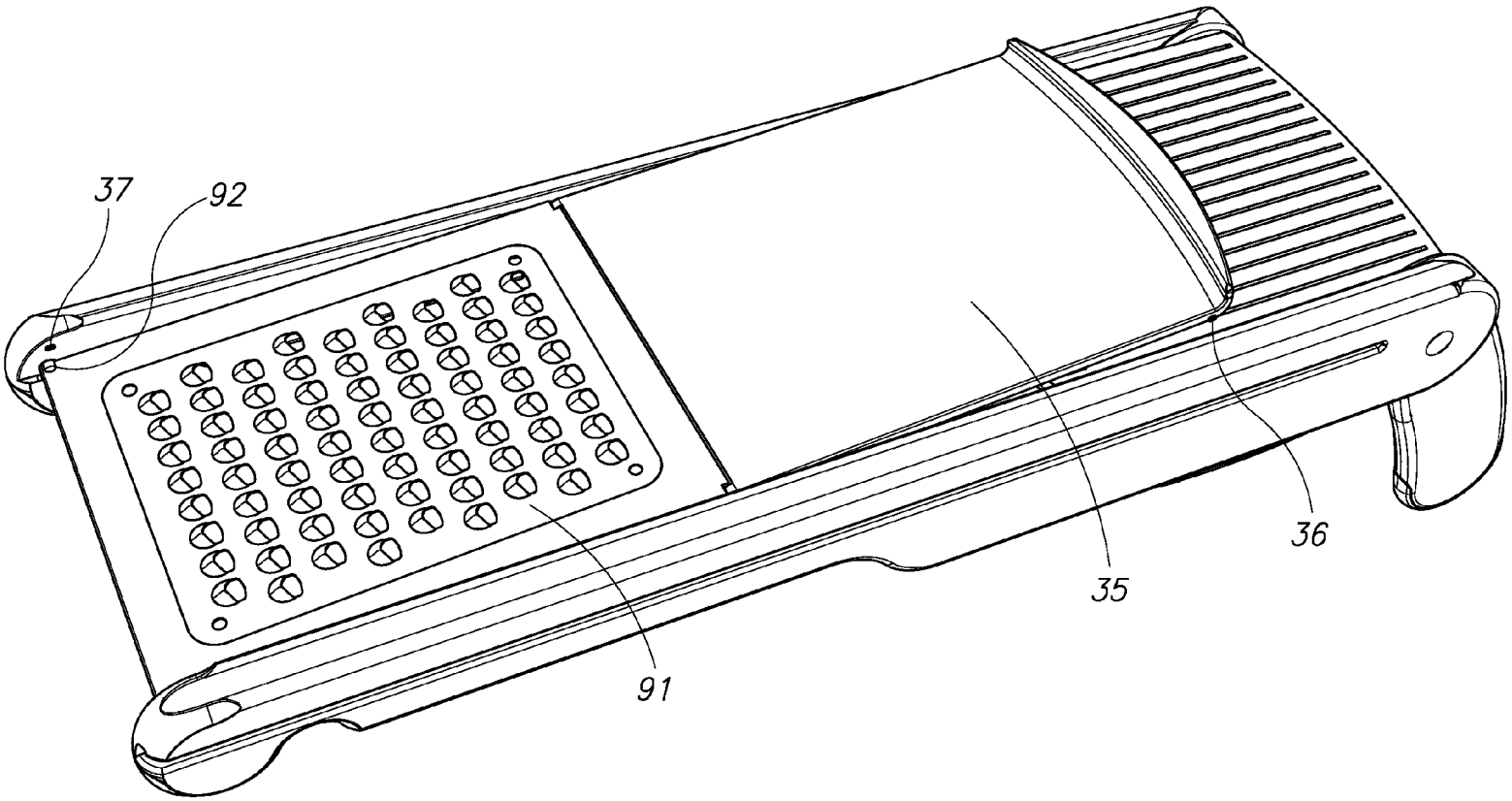
FIG. 9 is a top perspective view of the preferred mandolin slicer, shown without the hand guard and with a portion of the slicing ramp pivoted to expose a grating surface.

The second sidewall 34 of the slicer ramp includes a slot 50 (see FIGS. 3A and 3B) that extends along the majority of the length of the second sidewall (see FIG. 9). The slot is formed along the lateral outside surface of the sidewall, and is formed with a lower surface 52 that is generally horizontal, transitioning to a vertical wall 53 within the sidewall 34. Accordingly, an upper portion 53 of the slot is formed with an overhanging edge 52, such that the slot is configured as an L-shape when viewed from an end, perpendicular to the elongated side along which the slot extends.

Figure 3A:
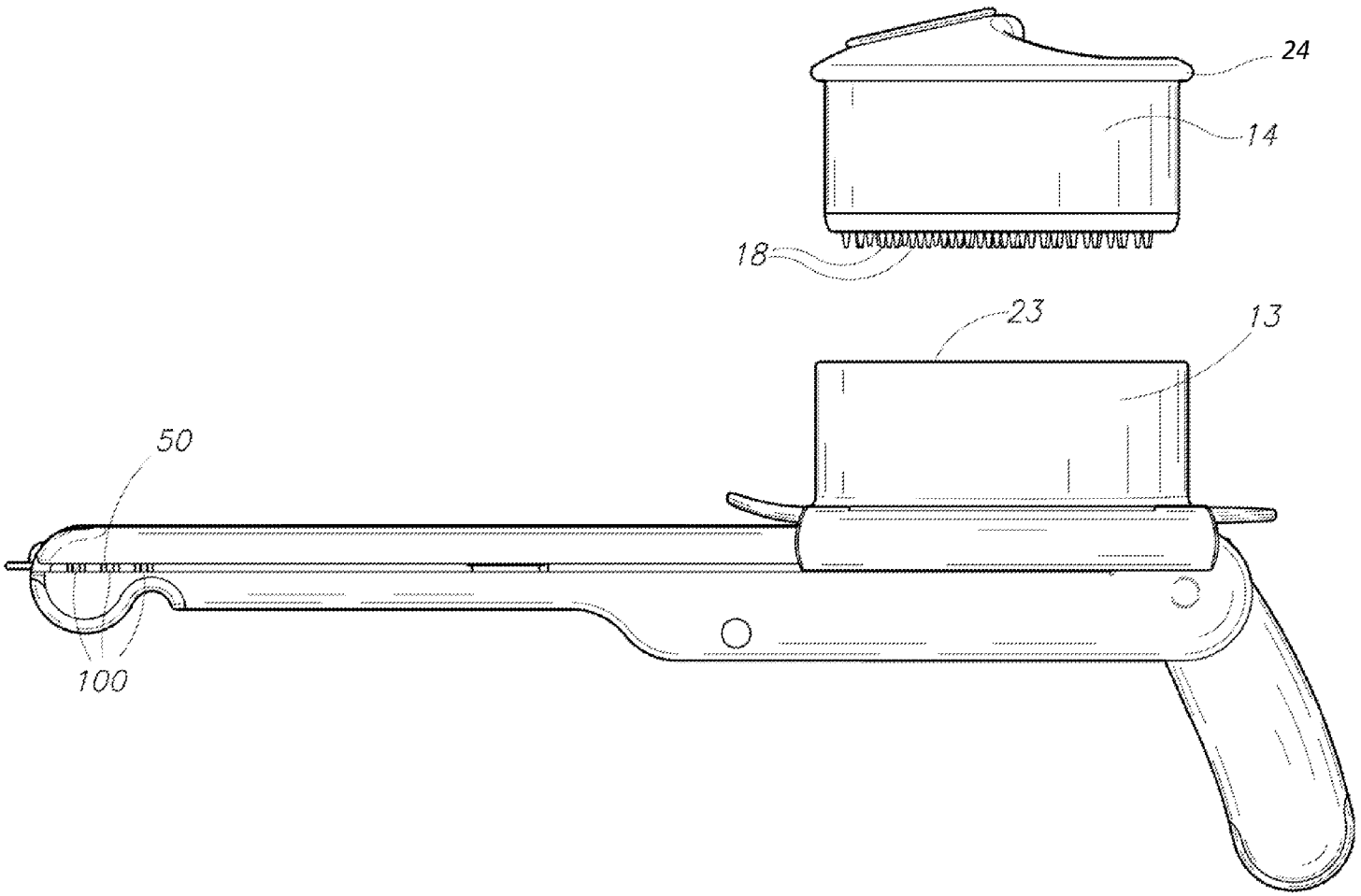
FIG. 3A is a side partial exploded view of the preferred mandoline slicer, shown with the hand guard partially exploded.
Figure 3B:
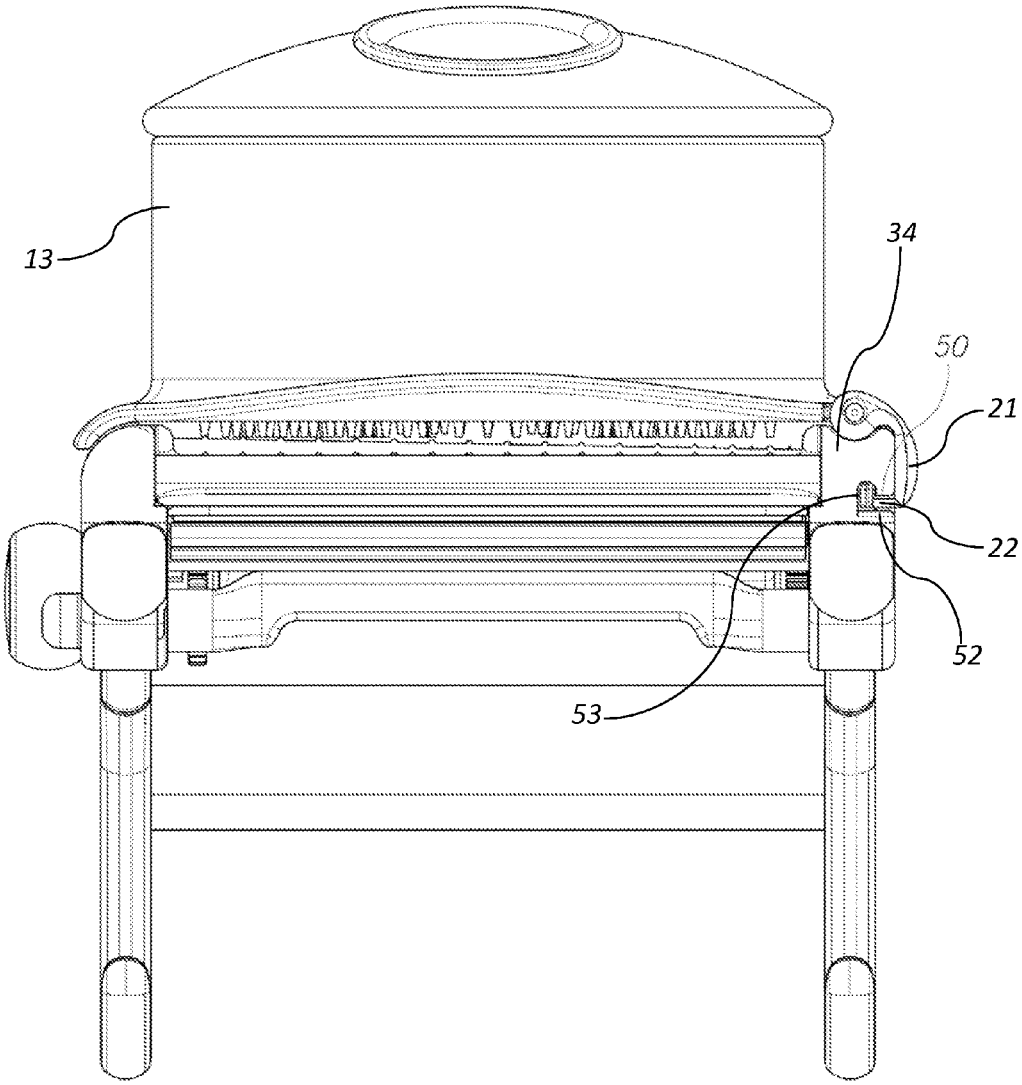
FIG. 3B is a front view of the preferred mandoline slicer.
Figure 7:
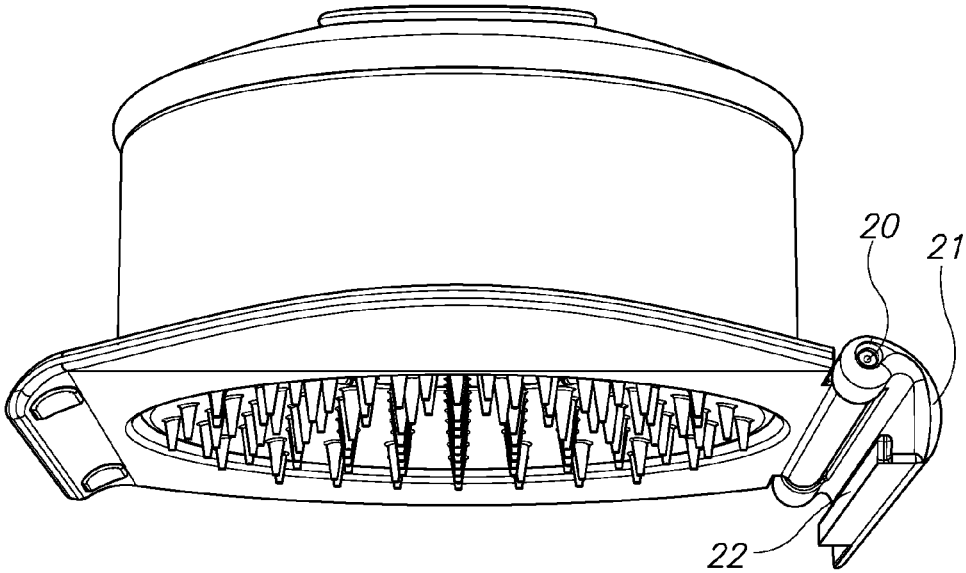
FIG. 7 is a bottom perspective view of the preferred hand guard for use with a mandoline slicer.

The coupling 21 is formed with a complementary finger configured 22 to be received within the L-shaped slot, as best seen in FIGS. 3B and 7. In the preferred version, the coupling includes a curved lateral face that extends from the pivotal connection along the upper portion of the guard wall downward to the slot. The lateral face transitions to a curved finger, in the version as shown having two substantially perpendicular bends such that the finger is trapped within the vertical portion of the L-shaped slot. Accordingly, the finger portion of the coupling cannot be inserted or removed from the slot in a lateral direction, but rather may only slide longitudinally along the slot. The coupling is inserted by positioning it at the open end of the slot at the end of the slicer, then sliding the coupling into the slot. Once in position, the grip and guard flange may be pivoted upward and away from the ramp 30 or pivoted downward such that it is parallel with the ramp.

Most preferably, when the guard is pivoted into an operable position parallel with the ramp (that is pivoted at the hinge 20 into the position as seen in FIG. 1), the lowest surface of the insert 14 and the gripping spikes 18 is raised somewhat above the surface of the ramp. This ensures that the grip and spikes are not cut by the slicer as it moves across the blade. The insert 14 is therefore formed with a peripheral flange 24 that abuts the upper rim 23 of the pillar in order to prevent the insert from falling fully through the pillar and contacting the ramp.

The second sidewall 34 further includes a channel 51 formed in the upper surface. The channel is sized and configured to receive the rounded shape of the hinge forming the pivot of the coupling, thereby allowing the hinge to slide smoothly down the sidewall.

In the preferred version, the ramp is adjustable to varying heights along the first portion of the ramp 31 leading to the blade 40. The first portion of the ramp comprises a substantially planar upper surface that is optionally formed with a plurality of ribs to reduce friction. The lower surface includes a pair of legs 90, 91 pivotally mounted to the lower surface and extending downward. The legs are positioned at opposite sides of the ramp, along the end of the ramp distant from the blade, and configured to abut the opposing sidewalls of the ramp. Each leg is pivotally secured to a respective one of the sidewalls to allow the first portion of the ramp to pivot about the pivot axis defined on the legs.

The upper end of the ramp 31 is pivotally movable about a pivot axis at the proximal end of the slicer, and in the preferred version the pivot axis is a common pivot axis also shared by the legs 90, 91 to allow the legs to pivotally rotate to a stored and deployed position. Thus, the legs 90, 91 and the first portion of the ramp 31 are both mounted along a common pivot axis at opposing pivot points 61, 62. A spring 63 is carried on the pivot axis of one of the legs 91 in order to bias the ramp in a downward position. Thus, in the preferred version the spring is a coil spring having one end attached to the lower side of the ramp and the opposite end attached to the sidewall adjacent the leg in order to urge the ramp downward and bias the portion of the ramp adjacent the blade into a downward position beneath the blade.

Figure 4:
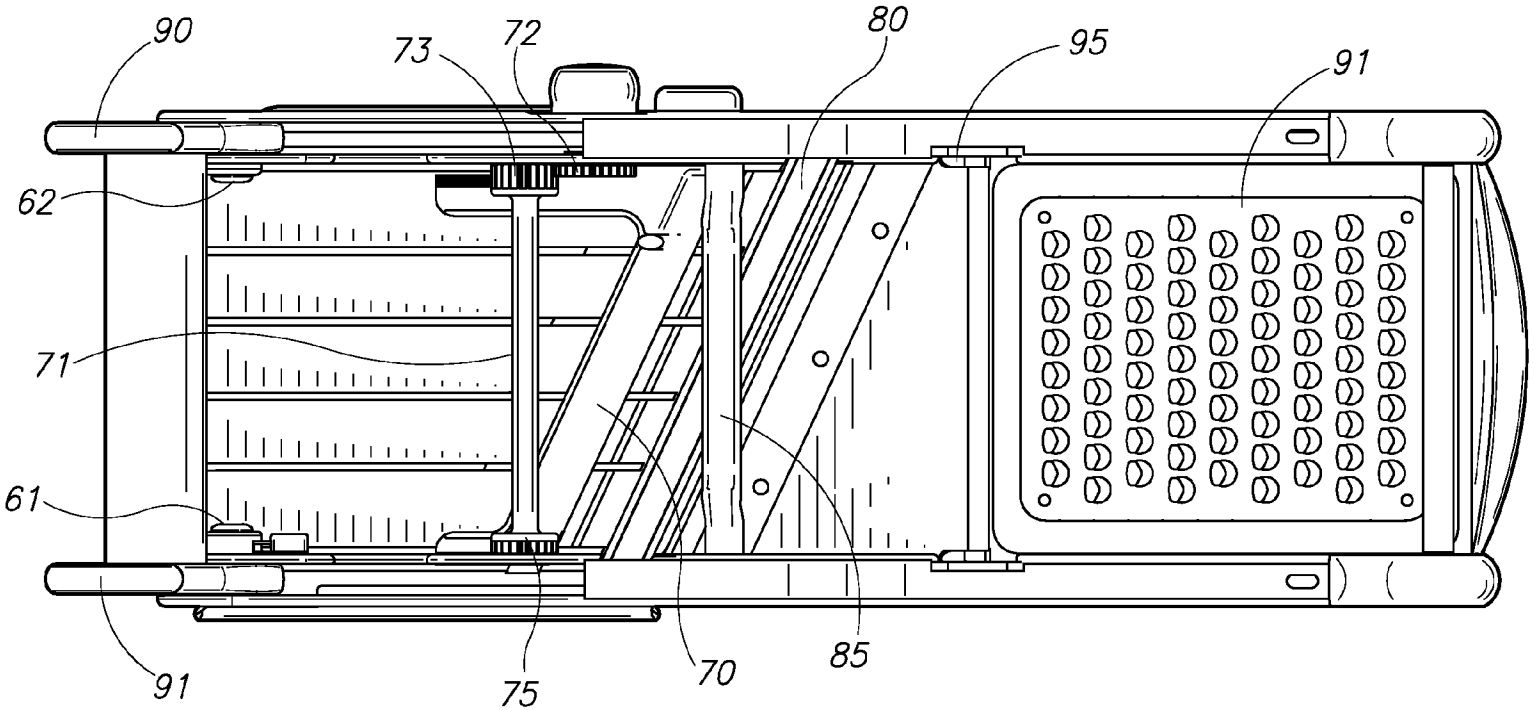
FIG. 4 is a bottom plan view of the preferred mandoline slicer.
Figure 5:
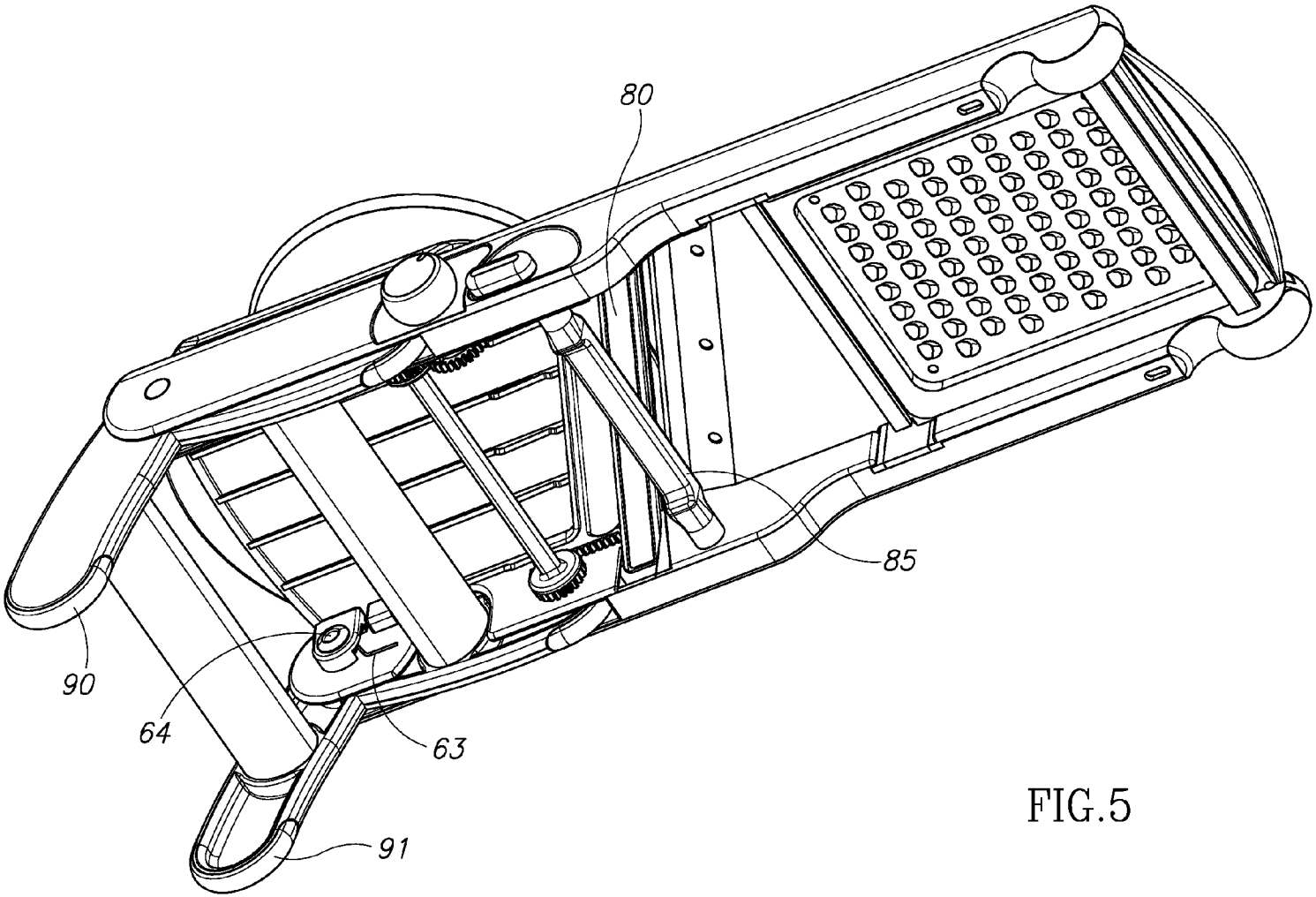
FIG. 5 is a bottom perspective view of the preferred mandoline slicer.
Figure 6:
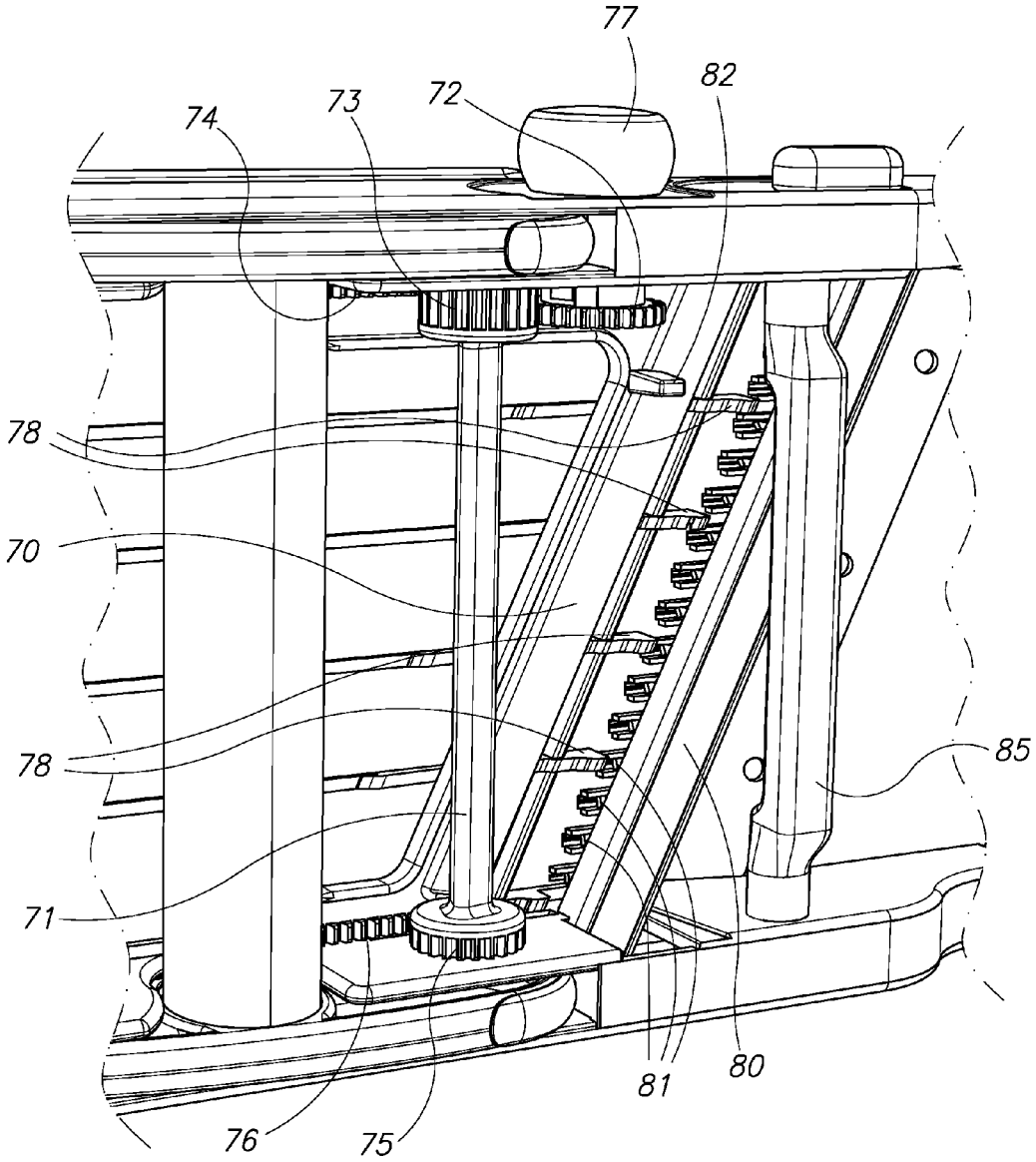
FIG. 6 is a partial close-up bottom view of the preferred mandoline slicer.

The first portion of the ramp 31 is adjustable in order to adjust the depth of the cutting blade with respect to the first end of the ramp adjacent the blade. Thus, the first portion of the ramp is selectively rotatable about the pivot point 64, thereby selectively altering the positioning of the edge of the first portion of the ramp with respect to the blade 40. The adjustment mechanism is best seen in FIGS. 4-6 showing the lower side of the ramp. A knob 77 is positioned on an outer surface of the sidewall and is carried on an axle for rotational movement. The axle extends through the sidewall to the inner surface of the sidewall where the axle secures to a first gear 72. The teeth of the first gear mesh with the teeth of a second gear 73 that is also pivotally supported by the sidewall. The second gear is further secured to an axle 71 that extends across the width of the ramp to the opposite sidewall. At the opposite end of the sidewall a third gear 75 is carried on the axle and pinned to the sidewall. Accordingly, rotation of the knob causes rotation of the first gear 72 and, by meshing of the teeth, rotation of the second and third gears 73, 75.

A ramp support 70 is slideably attached to the inner surfaces of the opposing sidewalls so that it may slide back and forth, generally along the plane formed by the first portion of the ramp. The support is generally in the shape of a skewed U, in which the base portion is angled and the two uprights are of unequal lengths. Each of the uprights includes a series of teeth 74, 76 that mesh with the teeth of a respective gear 73, 75. Consequently, rotation of the second and third gears (which are fixed in position to the sidewalls) causes lateral movement of the support structure by movement of the teeth 74, 76.

The base portion of the support structure (that is, between the two uprights) extends laterally across the width of the lower side of the first portion of the ramp. The lower side of the first portion of the ramp is formed with a series of stepped ribs 78 that are increasing in height as they move away from the pivot end of the ramp. Movement of the support 70 in a first direction (that is, in the direction toward the blade) causes the support structure to engage taller steps of the ribs, thereby pushing the ramp upward (with "upward" being a direction from the bottom side of the ramp toward the top side of the ramp). In the highest position, the ramp is preferably flush with or slightly above the sharpened edge of the blade so that no slicing may occur. Movement of the support in a second opposite direction (that is, away from the blade 40 and toward the legs) causes the support structure to engage shorter steps of the ribs 78, and the spring 63 urges the ramp downward, inclining it below the sharpened blade. By selectively rotating the knob 77 to cause the support to engage a desired level along the stepped ribs, a desired differential can be achieved between the vertical height of the ramp with respect to the position of the fixed blade. Accordingly, the thickness of the slices produced can be adjusted by turning the knob. As seen in FIG. 1, the sidewall may include thickness indicators adjacent the knob 77 to indicate to the user the relative slicing thickness at particular knob rotational locations.

Figure 8:
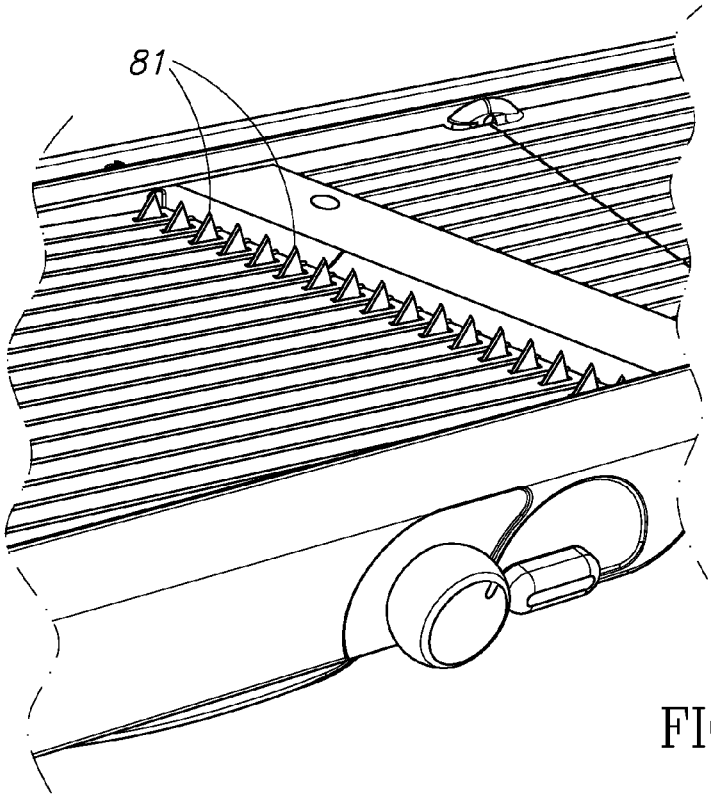
FIG. 8 is a partial close-up top perspective view of the preferred mandoline slicer.

A series of julienne blades may also be provided. As best seen in the close-up view of FIG. 8 and the bottom views of FIGS. 5 and 6, several blades 81 are carried by a bar 80 positioned beneath the lower surface of the slicer. A corresponding series of slots 39 is formed in the first portion of the ramp at a location adjacent the blade, such that each one of the vertical julienne blades is extendable upward and through the slots or retractable beneath the slots. The bar (and therefore the julienne blades) is preferably oriented to be parallel with the line defining the sharpened edge of the blade 40.

The vertical movement of the julienne blades 81 is effected via a lever pivotally mounted on an outer portion of one of the sidewalls. In the illustrated version, the lever is mounted adjacent the slicing adjustment knob. The lever 83 is carried on an axle extending through the sidewall and extending across the lower side of the ramp where it is pivotally mounted to the opposite sidewall. The julienne axle 85 includes a cam surface (best seen in FIG. 5) whereby rotation of the lever to a first position causes the cam surface to push the julienne bar upward and rotation of the lever to a second position moves the cam surface away from the julienne bar, allowing it to move downward. In the preferred version, the cam surface extends substantially along the entire length of the axle, in which one side of the axle is radially offset with respect to the opposite side of the axle. Both opposing sides of the axle have substantially flat surfaces so that they may engage the corresponding flat lower surface of the julienne bar 80. The engagement of the mutually flat surfaces prevents the julienne axle 85 from freely rotating unless a user turns the lever to cause it to rotate.

The slicing adjustment knob further includes a feature for ensuring that the julienne blades are retracted when the ramp is adjusted to a locked position. When the support 70 is moved to its farthest position, engaging the tallest steps on the ribs 78, the ramp is pushed upward to a height at least somewhat above that of the blade 40. Accordingly, the ramp is in a substantially safe position in which there is little or no risk if contact with the blade. Because the julienne blades are vertical and have a height that is above the height of the slicing blade 40 when they are deployed, the support 70 further includes a vertical stem 82 (see FIG. 6) extending downward from the support at the base of the U shape, in a direction away from the ramp. As the support slides toward the farthest step on the ribs, the stem encounters an edge of the julienne axle 85, causing it to rotate. If the julienne bar is already in the stowed position, the stem slides beneath the julienne bar without contacting it. Because of the offset axial alignment of the julienne axle, the rotation caused by the stem 81 will cause the julienne blades to retract to the stowed position beneath the surface of the ramp. Thus, rotation of the adjustment knob to the locked or stored position also causes the julienne blades to retract to a stored position if it is not already in that position. Appropriate indicators on the sidewall of the device provide a visual indication of the locked and deployed positions, as well as positions corresponding to the various steps in the ribs.

At the distal end the lower surface of the slicer includes feet having a nonskid or elastomeric material applied. At the proximal end, the slicer includes pivotally retractable legs 90, 91. When extended, the legs raise the rear end of the slicer with respect to the front end of the slicer, thereby forming a downward incline from the rear toward the front end of the slicer.

The forward or distal portion of the ramp 32 may be integrally formed with the ramp in some versions of the invention. In other versions of the invention, it is pivotally attached to facilitate use of a grating surface positioned beneath it. In such a version, the forward ramp surface 32 has a first end 35 adjacent the slicing blade and a distal second end. The first end is pivotally mounted so that the ramp may be rotated about the pivot point approximately 180 degrees. In the pivoted orientation, it covers the slicing blade and exposes a grating surface that otherwise lies beneath the forward portion of the ramp in its standard position. In FIG. 9, the first end 35 of the ramp is pivoted to expose the grating surface 91, while in the remaining figures it is pivoted to cover the grating surface.

A grating surface 91 is supported at the forward end of the slicer. In the preferred version, the grating surface is planar in shape and spans the width of the sidewalls. The grating surface is pivotally mounted to the forward end of each of the opposing sidewalls, for example at a location 92, so that it can pivot somewhat between a substantially horizontal stowed position and a slightly inclined operational position.

Adjacent the pivot axis of the forward ramp 32, each side includes an arm 95 extending rearward from the pivot point. As the forward ramp is pivoted upward and about the pivot axis carrying the arms 95, the arms rotate below the plane of the ramp and an end of the arms engage a lower surface of an end of the frame of the grating surface. As the forward ramp continues its pivotal movement to a point where it covers the slicing blade (that is, having been rotated approximately 180 degrees), the arm continues to pry the end of the grating surface upward. The face of the arm in contact with the grating surface is configured to support the end of the grating surface at a desired angle. In the preferred version, the grating surface is slightly inclined with respect to the plane defined by the overall ramp. Accordingly, the rotation of the forward portion of the ramp 32 causes the arms to slightly raise the adjacent end of the grating surface 91 such that the rotated forward end of the ramp 32 and the grating surface lie substantially in the same plane.

The forward portion of the ramp further includes one or more tabs 36 that are positioned to engage corresponding slots formed along the sidewalls, such that when the forward portion of the ramp is fully pivoted away from the grating surface the tabs engage the slots to hold the forward portion of the ramp in a position generally adjacent the slicing blade. In this position, the forward portion of the ramp is at or below the level of the upper surface of the sidewalls so that the guard may slide over the top of the forward portion of the ramp and along the grating surface. An additional pair of slots 37 is formed at the forward end of the sidewalls to engage the tabs when the forward ramp is in its stowed position, covering the grating surface.

As best seen in FIG. 3A, an inner surface formed in the L-shaped slot 50 further includes a stop configured to slow or limit travel of the hand guard coupling within the slot. In the preferred example, the stop is configured as section of resilient material, and as illustrated it forms a series of ribs 100 housing TPE or other resilient material. The TPE provides further frictional resistance, additionally helping retain the coupling within the slot while still allowing it to be removed if desired. In the illustrated version, three resilient ribs are shown. A greater or smaller number of ribs may be provided in alternate versions.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A mandoline slicer, comprising:

a slicing ramp having a proximal ramp portion and a distal ramp portion carried on a frame having opposing sidewalls, a gap being defined between the proximal ramp portion and the distal ramp portion;

the distal ramp portion having a slicing blade mounted along an edge of the distal ramp portion along the gap, the slicing blade having a sharpened edge facing toward the proximal ramp portion;

the proximal ramp portion having a first end adjacent the distal ramp portion and an opposite second end, the second end being pivotally mounted to the frame between the opposing sidewalls;

the proximal ramp portion further having an upper side and a lower side, the lower side having at least one rib extending downward from the lower side, the rib having a height below the lower side; and a support structure engaging the at least one rib and supporting the proximal ramp portion, the support structure being movable along a length of the rib;

whereby movement of the support structure in a first direction causes the proximal ramp portion to be raised, and movement of the support structure in a second direction causes the proximal ramp portion to be lowered;

the frame further having an L-shaped slot formed in one of the opposing sidewalls, the L-shaped slot having a horizontal portion opening to an outer surface of the one of the opposing sidewalls and a vertical portion joined to the horizontal portion and positioned inside the one of the opposing sidewalls, the L-shaped slot extending along the majority of the length of the one of the opposing sidewalls adjacent the proximal ramp portion and the distal ramp portion, and the L-shaped slot further comprises an overridable stop formed at a distal end of the L-shaped slot, the overridable stop being configured to resist travel of the coupling beyond the overridable stop, wherein the overidable stop further comprises a plurality of ribs formed from a resilient material and secured within the L-shaped channel; and a hand guard, the hand guard having a pillar with a peripheral flange, the peripheral flange having a coupling received within the L-shaped slot to secure the hand guard to the frame while allowing longitudinal movement of the coupling within the L-shaped slot, whereby the pillar is linearly moveable from the proximal ramp portion to the distal ramp portion.

2. The mandoline slicer of claim 1, wherein the at least one rib further comprises a plurality of ribs.

3. The mandoline slicer of claim 2, wherein each of the plurality of ribs further comprises a plurality of heights, the plurality of heights being defined as separate steps, the steps decreasing in height as the ribs extend from the first end of the proximal ramp portion toward the second end of the proximal ramp portion.

4. The mandoline slicer of claim 3, wherein the support structure is substantially U-shaped, having a base and a pair of opposing uprights, the base portion engaging the plurality of ribs and the upright portions being supported by the sidewalls for sliding movement of the U-shaped support between the sidewalls.

5. The mandoline slicer of claim 1, further comprising:

a plurality of slots formed in the proximal ramp portion adjacent the gap;

a plurality of julienne blades positioned beneath the proximal ramp portion for selective movement between a stowed position wherein the julienne blades are below the proximal ramp portion and an extended position wherein the julienne blades are at least partially extended above the proximal ramp portion; and a support bar mounted on the frame, the plurality of julienne blades being secured to the support bar.

6. The mandoline slicer of claim 5, wherein the support bar extends between the sidewalls along a line parallel to the sharpened edge of the slicing blade.

7. The mandoline slicer of claim 1, wherein the hand guard further comprises a removable insert.

8. The mandoline slicer of claim 7, wherein the insert further comprises a finger cup, the finger cup having a base portion and being sized to receive a plurality of fingers of a user, the insert further comprising a bore extending fully through the insert, the bore being configured to enable a food item to pass through the bore whereby the food item engages the slicing blade.

9. The mandoline slicer of claim 1, wherein the coupling is pivotally mounted to the pillar, whereby the pillar is pivotally movable between a first position adjacent the slicing ramp and a second position away from the slicing ramp.

10. The mandoline slicer of claim 1, wherein the overridable stop further comprises a section of elastomeric material secured within the L-shaped slot.

* * * * *